US005505245A

United States Patent [19]

Badalamenti

[11] Patent Number: 5,505,245

[45] Date of Patent: Apr. 9, 1996

[54] CHANNELED, FOAM CORNICE WINDOW TREATMENT

[75] Inventor: Rosario Badalamenti, Utica, Mich.

[73] Assignee: F & F Enterprises, Inc., Sterling Heights, Mich.

[21] Appl. No.: 276,696

[22] Filed: Jul. 18, 1994

[51] Int. Cl.[6] ..... E04F 10/00

[52] U.S. Cl. ..... 160/38

[58] Field of Search ..... 160/38, 39, 19, 160/330, 405, 327

[56] References Cited

U.S. PATENT DOCUMENTS

| | | | |
|---|---|---|---|
| 2,998,062 | 8/1961 | Bixby | 160/39 |
| 4,246,951 | 1/1981 | Givens | 160/39 |
| 4,966,218 | 10/1990 | Peters . | |
| 5,033,525 | 7/1991 | Paeselt | 160/39 |
| 5,042,549 | 8/1991 | Roberts | 160/39 |
| 5,062,463 | 11/1991 | Peters . | |
| 5,144,997 | 9/1992 | Marasco et al. | 160/38 X |
| 5,152,331 | 10/1992 | Barone . | |
| 5,345,990 | 9/1994 | Potts | 160/38 X |
| 5,361,821 | 11/1994 | Barone . | |

*Primary Examiner*—David M. Purol
*Attorney, Agent, or Firm*—Young, MacFarlane & Wood

[57] ABSTRACT

A foam cornice window treatment which is mountable on a curtain rod assembly including one or more flat, slat-like members. The foam cornice is formed of resilient foam material and includes a front non-planar surface which meets a rear, planar surface. One or more channels are formed on the rear face of the cornice for engagement with the slot(s) of the curtain rod assembly. The cornice includes a pair of rear slots formed on the rear face into which edges of a fabric covering may be tucked. Because of the resiliency of the foam body, the slots will open to receive the fabric edges, but will resiliently spring back to grip the fabric edges and hold them in place. A slot may also be formed on the front face of the cornice so that an intermediate portion of the fabric covering may be tucked thereinto to create a puffy, decorative effect.

10 Claims, 2 Drawing Sheets

FIG-3
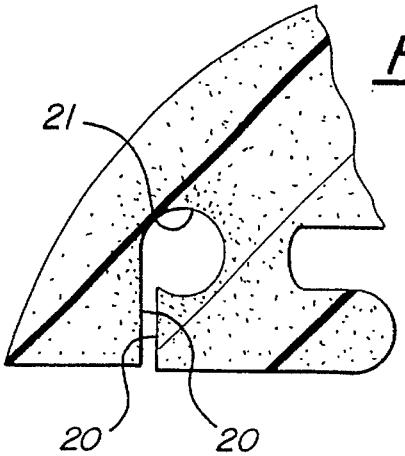
FIG-4
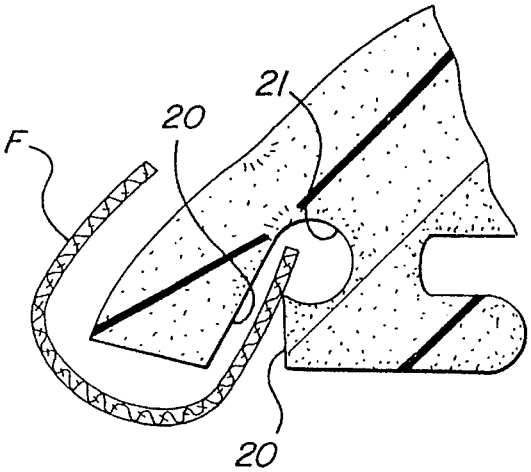
FIG-5
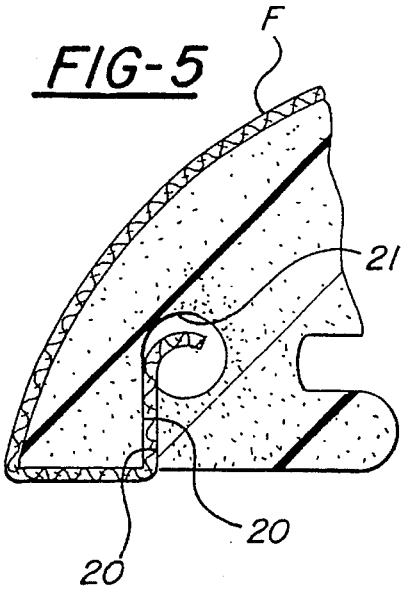
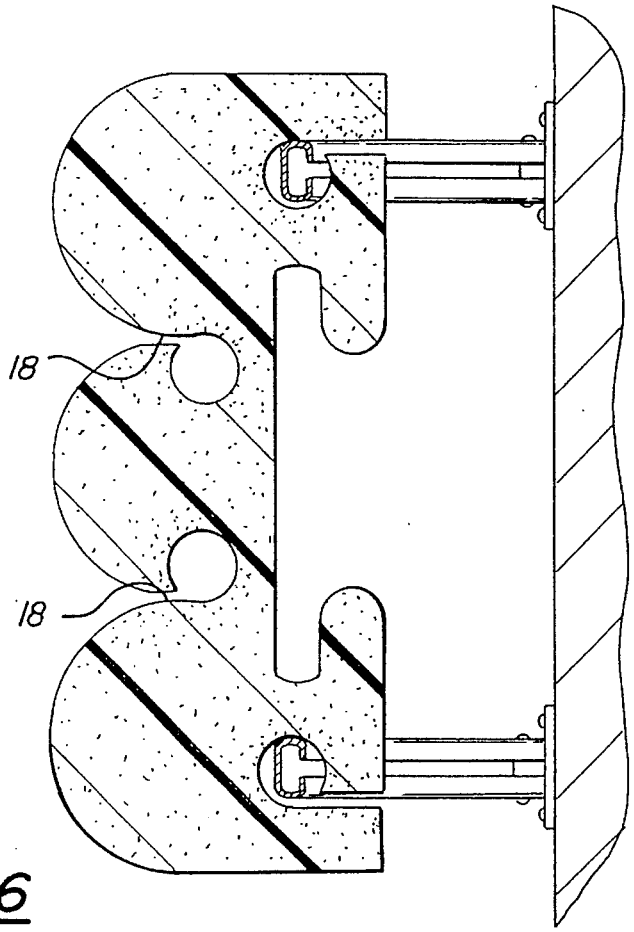
FIG-6

CHANNELED, FOAM CORNICE WINDOW TREATMENT

FIELD OF THE INVENTION

This invention relates to the field of decorative window treatments, and, more particularly, to such a window treatment which includes a cornice body formed of a resilient foam material which is mountable on a standard continental curtain rod and which may be covered with a decorative fabric to create various decorative effects.

BACKGROUND OF THE RELEVANT PRIOR ART

Various types of cornices, corniceboards and top window treatments have enjoyed increasing popularity in recent years. Such top window treatments are frequently used with vertical or horizontal blinds, or with more conventional draperies, to create a variety of decorative effects.

More traditional cornices and corniceboards are formed of wood, covered with padding, and then encased in decorative fabric. Obviously such products are both time consuming and expensive to make, and difficult to mount due to their weight. Hence, some cornices have been designed which employ lighter materials. For example, U.S. Pat. No. 5,042,549 discloses a foam cornice body which is formed of slabs of foam material which are glued or otherwise fastened together, the foam then being covered with a decorative fabric. The cornice disclosed in this patent is then fastened to the wall with brackets.

It is also known to form a cornice body from a single piece of foam. This type of foam cornice typically has a flat back face and an arched front face and includes a cutout portion on the back face which engages with a standard "continental" curtain rod of the type which is flat and relatively wide. This type of foam body is first covered with a decorative fabric so that the fabric covers the front face and wraps partially around the back face so that the fabric is fixed in place when the rod is inserted into cutout portion. The advantage of this type of foam cornice is that the fabric covering may be changed as desired to coordinate with redecoration schemes.

However, the foam cornices of the prior art are not entirely satisfactory, in particular, it is difficult to position a piece of fabric around the foam body for maximum decorative effect and keep the fabric in position while the cornice is being installed onto the brackets. Furthermore, even though the fabric covering can be changed, the overall decorative effect cannot be varied.

There is a need for a foam cornice which may be easily mounted on existing curtain rod assemblies which is both easier to install, and which holds the fabric covering more firmly in place. There is also a need for such a window treatment which includes provisions for changing the overall decorative effect as the user desires. There is a particular need for such a window treatment which is easy and inexpensive to manufacture and install.

SUMMARY OF THE INVENTION

The present invention has been designed to overcome the deficiencies in the prior art noted above. It is a top window treatment consisting of a foam cornice which engages with a curtain rod assembly including a flat, relatively wide curtain rod. The foam cornice comprises a resilient foam body configured to cover the curtain rod and extend for a distance from each edge thereof along the length of said rod. The resilient foam body includes a planar rear face and non-planar front face which extends to meet said rear face at top and bottom edges thereof. A channel integral with said foam body extends along said rear face for engagement with the curtain rod so as to mount said cornice body on said curtain rod assembly.

A pair of rear slots are formed on the rear face of said body proximate the side edges. The rear slots each extend for the length of the foam body and terminate in a blind cavity. Each of the slots defines a pair of opposed sides. A piece of decorative fabric may removably enclose the front face of the foam body by tucking one of its edges into each of the pair of rear slots.

The resilient foam body has sufficient resiliency such that the pair of rear slots deform from a first position, wherein the opposed sides are proximate each other, to a second position wherein a gap is formed between the opposed sides that the edges of the fabric covering may be received in the cavities. Because of the resiliency of the foam body, the slots tend to resiliently spring back to the first position after the fabric edges have been inserted therein so that the opposed sides grip the fabric edges between them and hold the fabric in place.

In One preferred embodiment, the cornice body may further include a first front slot which is formed in its front face and extends along the length thereof. Like the rear slots, the first front slot terminates in a blind cavity. An intermediate section of the fabric may be tucked into the front slot to create a different look. By tucking in the intermediate section of decorative fabric, the fabric will blouse out on each side of the front channel, thus creating a puffy, decorative effect.

Typically, the fabric covering will be formed of a piece of fabric which is two or three times longer than the length of the foam cornice, and, preferably, gathered or pleated. As the fabric is installed by tucking its edges into the various slots, the fabric gathers and pleats, again creating a puffy and decorative effect. Because the fabric covering is first installed upon the cornice body before the cornice is mounted to the brackets, decorative positioning of the fabric is much easier.

In another preferred embodiment, a plurality of front slots are provided on the front surface of the cornice body. These will be spaced apart from each other so that the fabric covering may be tucked in some or all of the slots, as desired, to create a plurality of decorative effects.

In another preferred embodiment of the foam cornice of the present invention, the front face is arched. However, the front face may be configured in a variety of decorative ways: for example, it may include a double arch, with an arch extending from each side of the front slot; it may be double arched with one arch larger than the other; it may have a planar section disposed either next to a single arch, or between two arches, it may include three arches, etc. Thus, by combining various configurations of the front surface and a plurality of front slots, the decorative possibilities are endless. Preferably, the foam body is formed of polyethylene foam since this has been found to have sufficient resiliency to deform when the fabric edges are inserted into the slots, and spring back to retain them as described above. However, other types of synthetic polymeric, or natural latex foams such as ether foams or ester foams may be employed provided they exhibit the characteristics of lightweight and resiliency as defined above.

BRIEF DESCRIPTION OF THE DRAWINGS

The following detailed description may best be understood by reference to the following drawings in which:

FIG. 3 is a detail view of a typical rear channel according to the present invention showing the channel in its first position without fabric inserted therein;

FIG. 4 is similar to FIG. 2 which shows the channel in its second position with an edge of fabric inserted therein;

FIG. 5 is similar to FIG. 2 but shows the channel sprung back to its first position and with an edge of fabric held therein; and FIG. 6 is a cross-sectional view of another embodiment of a foam cornice according to the present invention.

DETAILED DESCRIPTION OF THE PREFERRED EMBODIMENTS

Figure 1:
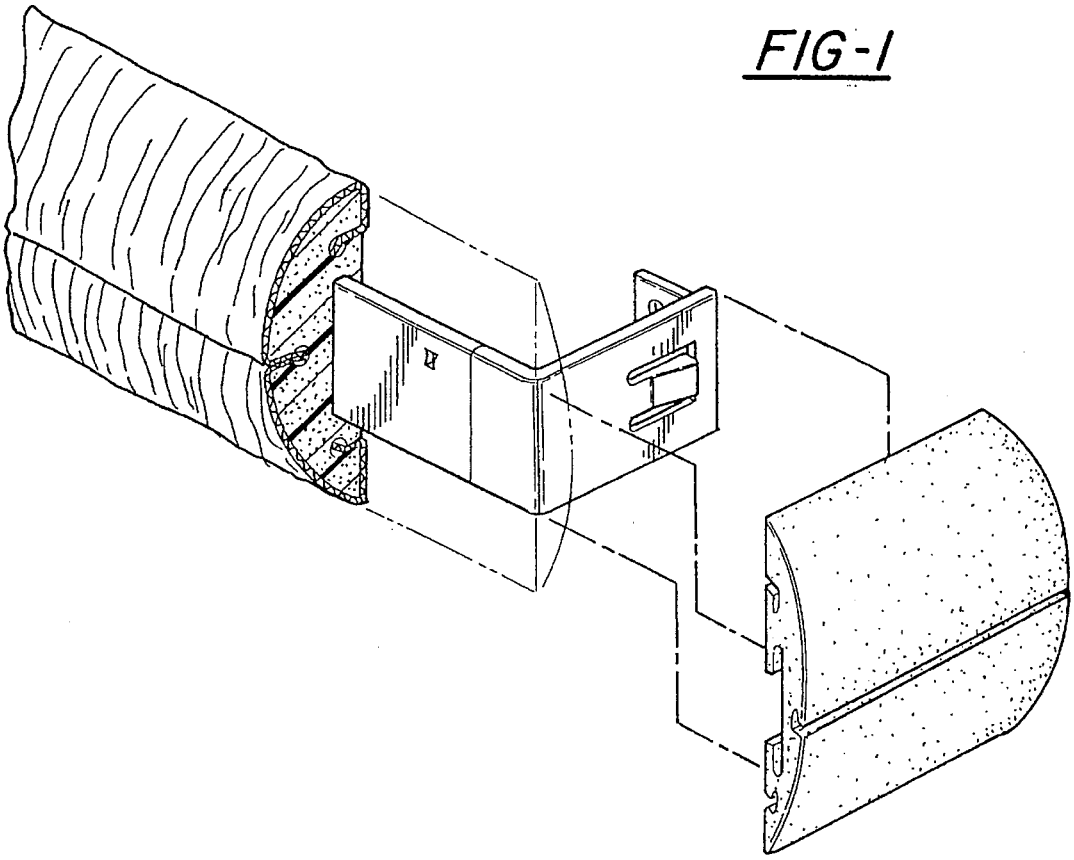
FIG. 1 is a perspective view of a foam cornice according to the present invention including a fabric covering and installed above a window.
Figure 2:
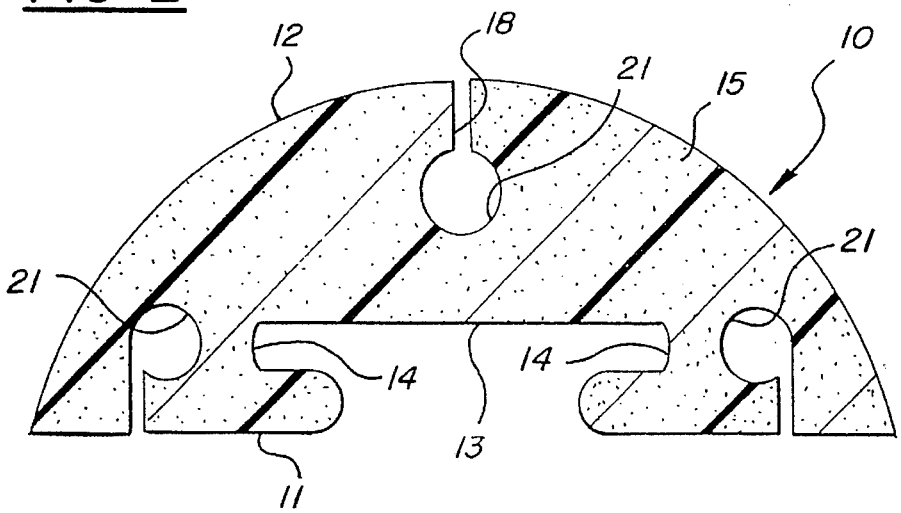
FIG. 2 is a cross-sectional view taken along the lines 2—2 of the foam cornice of FIG. 1.

Throughout the following detailed description, like numerals are used to reference the same elements of the herein invention shown in multiple figures thereof. Referring now to the drawings, and in particular to FIGS. 1 and 2, there is shown a foam cornice window treatment 10 according to the present invention. The foam cornice 10 is formed of a resilient, foam body 12 which includes a planar rear face 11 and a non-planar front face 15. In the embodiment shown in FIGS. 1 and 2, the front face 15 is configured as an arch, but many other configurations are possible, such as the configuration shown in the embodiment of FIG. 6. The non-planar front face 15 extends to meet the rear face 13 and define top and bottom edges 17 thereof.

A pair of rear slots 16 are formed in the foam body 12 and extend the length thereof. As may best be seen by referring to FIGS. 3–5, the slots 16 serve to grip the edges 22 of a piece of fabric F which is used to decoratively enclose and cover the front face 15 of the foam cornice 10. The fabric F could be pleated, gathered, or smooth. Each of the rear slots 16 includes a pair of opposed side edges 20 and terminate in a blind cavity 21. Because of the resiliency of the foam body 12, each of the rear slots 16 is capable of deforming from a first position (seen in FIG. 2) wherein the pair of opposed sides 20 are in close proximity to each other, to a second position (shown in FIG. 3) wherein a gap is formed between the pair of opposed sides 20 such that the edge 22 of a piece of fabric F may be inserted thereinto. Again, due to the resiliency of the foam body 12, the slots 16 will tend to spring back to their first position so that the opposed edges 20 will grip the edge 22 of fabric F and firmly hold it in place, as is shown in FIG. 4.

The foam body 12 also includes a channel 13 formed therewithin and extending along the length thereof. The channel 13 is for engagement with a "continental" type of curtain rod C which typically has a broad slat member which is insertable into the channel 13. Alternatively, a pair of separate, narrow slats may be mounted upon a wall so that they are parallel and spaced apart for an appropriate distance to be received in each cavity 21 of slots 16, as is shown in FIG. 6. The foam cornice 10 may be easily mounted on the curtain rod assembly by simply inserting the slat(s) of the curtain rod into the channel 13 or slots 16, irrespective of whether the slat(s) are singular or plural.

The embodiment of the foam cornice 10 depicted in FIG. 1 further includes a front channel 18 which is formed in the front face 15 thereof. In a manner analogous to the operation of the rear slot 16, the front slot 18 will retain a section of the fabric F which is tucked into it, thus creating the decorative effect seen in FIG. 1 wherein the fabric tends to puff out of the front slot 18 to create a pleasing, custom appearance. All of the slots 16,18 terminate in a blind cavity 21 so as to accommodate excess fabric and to facilitate tucking the fabric in.

The ends 14 of the cornice body 12 of the FIG. 1 embodiment are beveled at a 45° angle so that a smaller cornice body 12*a* (typically called a return, projection or depth), similarly beveled, may be fitted thereto. This arrangement allows the cornice 10 to extend along the entire length of the curtain rod C and around the corners thereof.

Other configurations of the front surface 15 of the foam cornice 10 of the present invention are possible, such as the configuration depicted in FIG. 6. In FIG. 6, two front slots 18 are disposed on the front face 15 of the cornice 10 and are spaced apart. Furthermore, the shape of the front face 15 as seen in cross section is no longer a simple arch, but has the more complex configuration depicted. Obviously, the decorative impression created by the cornice of FIG. 6 would be considerably different from that of the embodiment shown in FIGS. 1 and 2.

Moreover, the provision of one or more front channels 18 allows the user to vary the decorative appearance of the device. For example, the user may decide either to employ the front slot of the embodiment shown in FIGS. 1 and 2 or not. Thus, the user could decide on one occasion to simply ignore the front slot and simply tuck the edges of the fabric into the rear slots 16 to hold them in place prior to insertion into the slot or slots. By using a fabric strip which is gathered or pleated, the front slot 18 could come into play; the user could tuck a portion of the fabric into that slot to create the effect shown in FIG. 1. In the case of the FIG. 6 embodiment, even more possibilities may be realized since the user may employ as many or as few of the plurality of front slots 18 as desired to create different effects. Moreover, if the user desires a complete change of appearance, the existing fabric may simply be removed and a new one inserted. Another decorative effect may be achieved by using two (or more) pieces of fabric of different colors or textures and inserting them into the appropriate front slots.

Thus, it has been shown that the foam cornice of the present invention provides a simple, inexpensive way of creating a custom window treatment which is particularly easy to install since the fabric covering may be installed onto the cornice prior to the installation of the cornice onto the curtain rod assembly. Furthermore, the foam cornice may be easily manufactured in a number of different configurations to please varying consumer tastes. Furthermore, by providing one or more front slots, more variation in the appearance of the window treatment may be achieved as explained above.

While the above described invention has been disclosed with reference to certain embodiments and exemplifications thereof, doubtless one skilled in the art may, having had the benefit of the teachings of the present invention, achieve different design variations without departing from the scope of the present invention. For example, the rear face and channel of the cornice may be somewhat differently configured than those depicted to engage with window curtain assemblies having different types and shapes of rods. For example, a pair of channels could be provided on the back face to receive a pair of spaced apart curtain's rods. Thus, while the present invention has been described with reference to certain exemplifications and embodiments, the scope of the present invention is not limited as to what is depicted. Rather, it defined solely by the claims appended hereto, and all reasonable equivalents thereof.

I claim:

1. A foam cornice for engagement with a curtain rod assembly including at least one rod member, said foam cornice comprising:

a resilient foam body configured to cover and extend beyond said rod member, said foam body having a non-circular configuration and including a generally planar rear face adapted to be mounted on said rod member so as to mount said foam body on said curtain rod assembly and a front face extending to meet said rear face at top and bottom edges of the body; and top and bottom rear slots formed in said rear face of said foam body respectively generally proximate said top and bottom edges and extending for the length of said foam body, each of said rear slots defining a pair of opposed side edges opening outboard in the rear face of the resilient body and terminating inboard in a blind cavity coextensive with the side edges, said foam body having sufficient resiliency such that said rear slots are deformable from a first position wherein said opposed sides are in close proximity to a second position wherein a gap is formed between said opposed sides so as to provide access to said cavity.

2. The foam cornice of claim 1 further including a front slot formed in the front face of said foam body and extending along the length thereof such that an intermediate section of said fabric may be tucked into said front slot to create a decorative effect.

3. The foam cornice of claim 2 wherein said front slot comprises a first front slot and wherein the foam cornice further includes a second front slot formed in the front face of said foam body at a position thereon spaced from said first front slot and extending along the length of said foam body such that a second intermediate section of said fabric may be tucked into said second front slot to create another decorative effect.

4. The foam cornice of claim 1 wherein said front face is arcuate.

5. The foam cornice of claim 1 wherein said foam is formed of polyethylene foam.

6. The foam cornice of claim 1 wherein the foam body includes ends beveled at 45° and the cornice further includes a pair of foam returns, each having an end beveled at 45° to abut the beveled ends of the foam body.

7. The foam cornice of claim 1 wherein:

the cornice is intended for use with a curtain rod assembly including spaced top and bottom rods; and said top and bottom rear slots are spaced and sized to respectively receive said top and bottom rods whereby to mount the cornice on the curtain rod assembly.

8. A method of releasably positioning a decorative fabric with respect to a wall surface comprising the steps of:

providing a material that is resilient and yet capable of maintaining any shape in which it is formed;

providing a rigid mounting member defining an elongated mounting surface;

positioning the mounting member on the wall surface with the support surface extending generally horizontally;

forming a fabric support member from the material having a non-circular configuration and including a generally planar rear face and a front face;

forming a horizontally extending groove in the rear face of the fabric support member sized to releasably accommodate the mounting surface;

providing at least one piece of decorative fabric having top and bottom edges;

providing at least one horizontally extending slot in the front face of the fabric support member;

mounting the fabric support member on the mounting member with the groove releasably positioned over the mounting surface; and positioning the decorative fabric in covering relation to the front face of the fabric support member by releasably positioning a central portion of the fabric in the slot and releasably positioning the top and bottom edges of the fabric at vertically spaced top and bottom locations in the rear face of the fabric support member.

9. A method according to claim 8 wherein:

the fabric support member comprises a cornice; and the rigid mounting member comprises a curtain rod.

10. A foam cornice for use with a curtain rod assembly including at least one rod member, said foam cornice comprising:

a resilient foam body configured to cover and extend beyond said rod member, said foam body having a non-circular configuration and including a generally planar rear face adapted to be mounted on said rod member so as to mount said foam body on said curtain rod assembly and a front face extending to meet said rear face at top and bottom edges of the body; and top and bottom rear slots formed in said rear face of said foam body respectively proximate said top and bottom edges and extending for the length of said foam body whereby a piece of decorative fabric may removably cover and enclose said front face of said foam body by tucking one edge of said fabric into said top rear slot and tucking the other edge of said fabric into said bottom rear slot;

the cornice being intended for use with a curtain rod assembly in which the at least one rod member comprises a single central slat member and the rear face of the cornice further including a channel extending for the length of the foam body between said top and bottom rear slots and sized to receive said slat member whereby to mount the cornice on the curtain rod assembly.

* * * * *